US009783936B2

(12) United States Patent
Gareis et al.

(10) Patent No.: US 9,783,936 B2
(45) Date of Patent: Oct. 10, 2017

(54) DEVICE FOR SCREWING AND UNSCREWING BOLTS AND SCREWS BY MEANS OF A MOTOR-DRIVEN SCREWDRIVING TOOL

(71) Applicant: Loesomat-Schraubtechnik Neef GmbH, Vaihingen/Enz (DE)

(72) Inventors: Marc Gareis, Leonberg (DE); Thomas Jaekel, Neusaess (DE)

(73) Assignee: Loesomat-Schraubtechnik Neef GmbH, Vaihingen/Enz (DE)

( * ) Notice: Subject to any disclaimer, the term of this patent is extended or adjusted under 35 U.S.C. 154(b) by 338 days.

(21) Appl. No.: 14/424,482

(22) PCT Filed: Aug. 26, 2013

(86) PCT No.: PCT/DE2013/000490

§ 371 (c)(1),
(2) Date: Feb. 27, 2015

(87) PCT Pub. No.: WO2014/032643

PCT Pub. Date: Mar. 6, 2014

(65) Prior Publication Data

US 2015/0225905 A1 Aug. 13, 2015

(30) Foreign Application Priority Data

Aug. 31, 2012 (DE) ..... 10 2012 017 271

(51) Int. Cl.
*E01B 29/28* (2006.01)
*B25F 3/00* (2006.01)
(Continued)

(52) U.S. Cl.
CPC ..... *E01B 29/28* (2013.01); *B25B 21/00* (2013.01); *B25B 21/002* (2013.01);
(Continued)

(58) Field of Classification Search
CPC ..... B25B 21/00; B25B 23/14; B25B 23/147; B25B 21/002; B25B 23/0078; B25B 23/18; B25F 5/02; B25F 3/00; E01B 29/28
See application file for complete search history.

(56) References Cited

U.S. PATENT DOCUMENTS 5,624,000 A 4/1997 Miller
5,984,022 A 11/1999 Harman, Jr. et al.
(Continued)

FOREIGN PATENT DOCUMENTS

CN 1247791 A 3/2000
CN 101200057 A 6/2008
(Continued)

OTHER PUBLICATIONS

Russian Office Action dated Nov. 14, 2016 in Russian Application No. 2015111508 with English translation of relevant part.
(Continued)

*Primary Examiner* — Robert Scruggs
(74) *Attorney, Agent, or Firm* — Collard & Roe, P.C.

(57) ABSTRACT

A device for screwing and unscrewing bolts and screws uses a motor-driven screwdriving tool, which is preferably used in the track region of railroad facilities. The device makes it possible to screw and unscrew screws, nuts and bolts reliably and effectively, preferably in the context of railroad use. The appliance is intended to have a low weight and a high output over long periods of use, can be operated with one hand, is specifically pre-oriented to the various applications and has a modular construction. To this end, the device has a central rib which serves as a receptacle for all of the attachments and fittings to be installed in a modular manner.

22 Claims, 5 Drawing Sheets

(51) Int. Cl.

| | |
|---|---|
| ***B25B 21/00*** | (2006.01) |
| ***B25B 23/00*** | (2006.01) |
| ***B25B 23/14*** | (2006.01) |
| ***B25B 23/18*** | (2006.01) |
| ***B25F 5/02*** | (2006.01) |
| ***B25B 23/147*** | (2006.01) |

(52) U.S. Cl.

CPC ..... *B25B 23/0078* (2013.01); *B25B 23/14* (2013.01); *B25B 23/147* (2013.01); *B25B 23/18* (2013.01); *B25F 3/00* (2013.01); *B25F 5/02* (2013.01)

(56) References Cited

U.S. PATENT DOCUMENTS

| | | | | |
|---|---|---|---|---|
| 6,286,611 | B1 * | 9/2001 | Bone | B25F 3/00 173/170 |
| 7,090,032 | B2 * | 8/2006 | Wada | B25B 21/02 173/128 |
| 7,152,695 | B2 * | 12/2006 | Happ | B25F 5/006 173/162.1 |
| 7,322,427 | B2 | 1/2008 | Shimma et al. | |
| 2007/0256914 | A1 * | 11/2007 | Lohr | B25B 21/00 200/5 A |
| 2008/0098863 | A1 | 5/2008 | Kaneyama et al. | |
| 2009/0194306 | A1 * | 8/2009 | Johnson | B25F 5/006 173/162.1 |
| 2010/0154599 | A1 | 6/2010 | Gareis | |

FOREIGN PATENT DOCUMENTS

| | | | |
|---|---|---|---|
| CN | 101590632 | A | 12/2009 |
| DE | 1 087 539 | B | 8/1960 |
| DE | 25 50 819 | A1 | 6/1976 |
| DE | 695 30 892 | T2 | 2/2004 |
| DE | 20 2010 007 235 | U1 | 8/2010 |
| DE | 20 2012 100 275 | U1 | 3/2012 |
| EA | 010555 | B1 | 10/2008 |
| EP | 1 607 189 | A2 | 12/2005 |
| JP | 2011-73109 | A | 4/2011 |
| RU | 2 296 667 | C2 | 4/2007 |
| RU | 2010 107 174 | A | 9/2011 |
| SU | 656539 | A3 | 4/1979 |
| WO | 2006/058552 | A1 | 6/2006 |
| WO | 2009/015644 | A1 | 2/2009 |

OTHER PUBLICATIONS

International Search Report of PCT/DE2013/000490, dated Jan. 21, 2014.

German Examination Report dated May 15, 2013 in German Patent Application No. 10 2012 017 271.0 with English translation of the relevant parts.

Chinese Office Action in CN 201380051166.X, dated Nov. 27, 2015.

* cited by examiner

DEVICE FOR SCREWING AND UNSCREWING BOLTS AND SCREWS BY MEANS OF A MOTOR-DRIVEN SCREWDRIVING TOOL

CROSS REFERENCE TO RELATED APPLICATIONS

This application is the National Stage of PCT/DE2013/000490 filed on Aug. 26, 2016, which claims priority under 35 U.S.C. §119 of German Application No. 10 2012 017 271.0 filed on Aug. 31, 2012, the disclosures of which are incorporated by reference. The international application under PCT article 21 (2) was not published in English.

The invention relates to a device for screwing and unscrewing bolts and screws by means of a motor-driven screwing tool, which is preferably used in the track region of railroad facilities.

There are multiple possibilities for using small screwing machines in the track region of railroad facilities to screw and unscrew or to tighten the various screws and bolts. Such universal screwing machines are offered by various companies and are positioned onto the tracks by means of a trolley and driven via a combustion engine. They are preferably used for tightening or unscrewing clip bolts and coach screws. The disadvantage of these screwing machines is their high weight of about 100 kg as well as the fact that at least two people are needed for repositioning it. Since railway facilities are often located in difficult and hard-to-access territory, the transport of such heavy screwing machinery is often extremely laborious and associated with considerable physical difficulties for the respective workers.

From DE 1 087 539, a device for screwing and unscrewing bolts is known, comprising a carriage on which a screwdriver tool, which is mounted in a slidable manner, is laterally arranged.

The described impact screwdriver comprises an electrical drive and requires a power connection, which is not always available on the rail construction site.

What is also known are battery operated-impact screwdrivers. However, their output is often too low or their energy consumption too high, which has a negative effect on productivity. Further, handling of these appliances is still inconvenient and sometimes they are excessively heavy. Besides, it is regularly necessary to use both hands in order to operate them because these impact screwdrivers are drawn at an angle due to the often heavy battery, and thus they cannot be centered on the screw or the bolt with only one hand. Another disadvantage is that it is not possible to achieve a sufficient bracing precision in the tightened screws.

What is further known is a device for screwing and unscrewing bolts and screws by means of a screwdriver tool, in which a pipe is arranged that is positioned off-center with regard to the vertical axis of the device, wherein the device comprises:

- arranged in its upper area, a height-adjustable handle that is fixed at the pipe by means of a sheath, with the handle having an on-/off-switch as well as a change-over switch for clockwise and anti-clockwise rotation, [and] a torque indicator by which the necessary torque can be set,
- arranged in the middle area, a motor that has a removable battery block directly attached thereon, as well as a rotatable grab handle,

- in the lower area, a gear box and attached thereon a gearing with a fastening spigot and a counter torque wrench that is affixed to the gearing (DE 20 2010 007 235 U1).

This device has the disadvantage that its design is not sufficiently compact and that the orientation towards a torque that is to be introduced does not sufficiently correspond to the existing requirements in rail construction.

It is also known that different screw connections have different characteristics which can lead to problems with regard to preset torques. Differences in the individual screw applications especially arise from screws, nuts and bracing elements comprising different materials, but also appear when the screwing means have different thread pitches, etc.

Consequently, a uniform machine setting to a particular torque does not allow for uniform work results. The reasons also lie in the different dynamic behavior of the mass as it gathers momentum through the screwing process.

The invention is based on the object of developing a device which makes it possible to screw and unscrew screws, nuts and bolts in a reliable and effective manner, preferably in the context of railroad use, wherein the appliance is intended to have a low weight and a high output over long periods of use, can be operated with one hand, is specifically pre-oriented to the various applications and has a modular construction.

This is achieved through a device according to the invention.

Here, the central rib is constructed in such a manner that it has

- a U-shaped insert that is open to the top and is meant for a battery as well as for an grab handle,
- a compartment that is open to the side and that is meant for a control device,
- reception area that is aligned horizontally upward and that is meant for a display,
- U-shaped insert that is open to the bottom and that is meant for the machine-drive,
- and a downward-facing insert for an illumination device.

A sheath that is guided around the rotating parts is attached at the machine-drive or at the two-shell housing or at the central rib, with a U-shaped counter torque wrench being formed at the sheath.

The counter torque wrench has a fork-shaped recess at both of its ends and is leaned against the track which is to be worked on as a gauge. It is constructed in such a manner that its width corresponds exactly to the respective space between the fastening means (screw, nut etc.) and the track cheek and can be used for all known vertical track screw connections. For horizontal screw applications, the counter torque wrench is arranged so as to be exchangeable with view to different widths and lengths.

Between the machine housing and the gear box, a special slewing ring is arranged preferably by frictional locking. Thus, the screwing device is designed so as to be rotatable in its fitted state (on the fastening means). The traction is effected from the gear housing via the reaction arm into the track and tie, further via the screw, screw socket and the square back to the gear box. The machine is not put under any stress by the screwing torque. In particular, this has the following advantages: The danger of accidents is reduced, since in this way the force action of the machine on the operator is limited to the friction of the screw cap in the event that the counter torque wrench does not catch. The application possibilities of the machine are enhanced and rendered more flexible. For example, when the device is alternately used left and right of the track, the user can move the machine into the ergonomically optimal position, without having to take into account the position of the counter torque wrench. Through the effect of the screw force, the machine cannot be damaged during the screwing process. Because the gear unit can be rotated, injuries (contusions) to the user are avoided should there be any interfering contours in the area of the operating handle.

The display can be arranged in a rotatable manner so that the device can be operated in the same orientation from two sides, without having to replug it as the change in direction occurs. Alternatively, the display can be rotated by 180 degrees by using software, with the operating buttons also adjusting their function accordingly.

The display has a rotatable knob for selecting different menu items, such as screw applications, wherein each screw application represents a special kind of screw and/or a special fastening means and/or a special fastening variant and/or a special torque of the rail.

Further, the design of the machine's microprocessor control makes it possible to store individual screwing processes. What can be documented, among other things, are, e.g.: sequential number, date, time of day, construction type of the track, bracing moment, clearance reduction, status.

Optionally, these data can be read out from the device via an integrated inductive interface and can be read-in to a laptop or the like. In the PC, other data can be added to the screwing application protocol, such as, e.g., name of the site, site manager, track section, and many more.

Particularly when it comes to screw applications that are carried out in the field of rail construction, they may be extremely different in their execution, so that the result varies very strongly. This is referred to as dynamic wrenching behavior in the technical field. In contrast to static wrenching behavior, in the case of dynamic wrenching behavior the moving mass of the screw connection device as well as the kind of the screw application itself has a great influence on the torque-controlled tightening behavior of the screw connection. This is taken into account by simulating the exact screw application on the torque test device. In this way, the screw application that is practically occurring is completely reconstructed with the original screw, fastening materials, friction conditions, etc. and the device is taught-in ("calibrated") accordingly.

According to the invention, during rail construction works the machine is calibrated in correspondence with current screw applications particularly in such a manner that during use the operator sets the present screw application instead of setting the desired torque. In this way, it can be guaranteed for the very first time that the desired work result is achieved and that the different characteristics of each individual screw application are taken into account here. New screw applications can be taught-in to the device at any time in connection with a suitable torque test stand.

Another embodiment provides that a GPS receiver is arranged at or inside the housing for the purpose of enhancing the precision of the documentation. It is connected to a data processing unit, so that it becomes possible to assign exactly one screwing process [and] exactly one special screw application to each screw and fastening means. Thus, it may be tracked precisely with which parameters which fastening means has been tightened at which point in time. Furthermore, it is possible to send the entire data packet to a central unit and/or to locate the position of the device.

The display is designed in an angled position and comprises a sun shield so that a better reading of the displayed data is ensured.

Located in the forward direction with regard to the working direction (alternatively in backward direction), the grab handle has at least one or a plurality of on-/off-switches and/or changeover switches for the purpose of turning on/off and/or for the rotational direction of the tool.

The grab handle is height-adjustable and open on one side and is optionally formed so as to be detachable and/or rotatable.

Via a height-adjustable side arm, the device can be connected to a rail car and can be attached to the same.

Optionally, the rail car has a container for receiving an (additional) battery or an aggregate. As an aggregate, a power generating set equipped with a combustion engine is suitable, with the power generating set being connected to the screwing device. In this way, the screwing device can be operated with hybrid technology, i.e. a battery-only operation where the charging occurs via the power generating set, or a combined operation for covering power surges is possible.

The device has an illumination that is preferably located in the lower area (gear box or motor) and that is arranged at a position angled towards a working tool.

In the lower area of the two-shell housing, between the illumination and the rotating parts, a double-sided housing recess area is arranged as a meshing area for fixating and holding the device.

A grab handle can be integrated inside the recovery area.

Since enormous heat development can occur due to the high torque and the performance requirements, a fan is optionally arranged inside the two-shell housing so as to cool the machine drive whenever necessary.

A crucial feature of the screwing device is the arrangement of the handle for the one-hand operation of the device. The entire machine and particularly the central rib are formed in such a way that the handle can be attached in the vertical axis of the center of gravity of the entire device. Here, the entire screwing device is oriented in such a manner that a complete counterbalance adjustment occurs, so that a one-hand operation is possible in an easy and uncomplicated way. As a result it is excluded that additional forces act on the wrist of the user, thus facilitating effortless working.

The screwing device is optionally connected to a rail car via a height-adjustable side arm and attached thereto.

The rail car optionally has a container for receiving an (additional) battery and/or an aggregate. Here, the battery or the aggregate is electrically connected to the screwing device, which may optionally be done via the height-adjustable side arm.

In the lower area of the machine, a suitable, preferably an LED illumination, is located at an angled position with orientation towards the work site.

ADVANTAGES OF THE INVENTION

- the screwing device can be used easily and is universally applicable,
- enormous weight and volume advantage as compared to conventional machines facilitates resource-saving transport and application of the device,
- instead of the three operators that have so far been necessary, only one user is required to transport the device according to the invention to the application site, to set it up, operate it and relocate it,
- it is possible to work ergonomically, since the allowed threshold values of the stress on the operator cannot be exceeded,
- the risk of accidents is considerably reduced, environmentally friendly working method with a purely electrical drive, the special shape of the central rib facilitates that all add-on or installed components can be fitted in on a modular basis, so that no complicated frame is necessary, whereby weight is saved, high torsional and flexural strength and low weight are achieved at the same time, symmetric setup of the machine is facilitated, plug-in and guiding options of individual components are provided, it becomes possible to maintain a centrally located center of gravity as well as a central arrangement of the structural components, good accessibility, ease of operation and maintenance friendliness are provided an ergonomic an easy operation is possible thanks to the arrangement of the handle vertically above the machine's center of gravity, the display is optionally designed so as to be rotatable, so that an easy change of direction is possible without having to reposition the device, through the adjusting wheel arranged at the display, different screw applications can be selected, while each screw application is exactly adjusted to the screw that is to be screwed-in as well as to the used fastening means; in this way, an error-free operation of the device is possible, so that negative effects on the screw, the fastening means or the rail or tie are avoided, the control system makes it possible to tighten individual screw connections by a particular number of fractional parts of revolutions, the GPS receiver that is optionally arranged inside the housing provides an exact assignment of all screwing processes to the screw application and to the concrete fastening means via the data processing system, so that it can be verified afterwards whether all regulations have been observed, the electronic control of the machine optionally facilitates storage and contactless read-out of data, whereby all screwing processes can be subsequently ascertained and double-checked.

the counter torque wrench is attached to the device in such a way that rotation of the same is possible at any time, without having to actuate the drive; in this way, the user can position the device or rotate it in any orientation in a way that is adjusted to the local conditions, through the replaceable counter torque wrench, the device can be adjusted exactly to the fastening means or the concrete kind of rail and be guided exactly at the rail head during the entire screwing and unscrewing process, the upper handle is designed so as to be height-adjustable and that it may be adjusted to the respective height of the user, thanks to the double-sided arrangement of on/off-switches at the hand grip, the device can be operated in both working directions without requiring any replugging, the device is constructed such that a counterbalance adjustment to the battery occurs and that it can be guided with one hand and be centered on the screw or the bolt without any problems, without having to use a second hand for this purpose, the device can be used as a purely handheld device and, with the help of the rail car, also as a rail-going combination device, through the use of an electronically controlled electric motor, the optimal number of revolutions as well as a high bracing precision are achieved, through the angled illumination attached in the lower area of the machine, a nighttime use as well as an exact illumination of the working site is also facilitated, the special shape of the reaction arm (counter torque wrench) saves weight while also achieving optimal tightness. Through the recess in the area of the reaction arm, the beam of light of the machine illumination reaches the head of the screw without any problems, thus facilitating an optimal working process.

EXEMPLARY EMBODIMENT

In the following, the invention will be explained in more detail by using the following exemplary embodiment.

Figure 1:
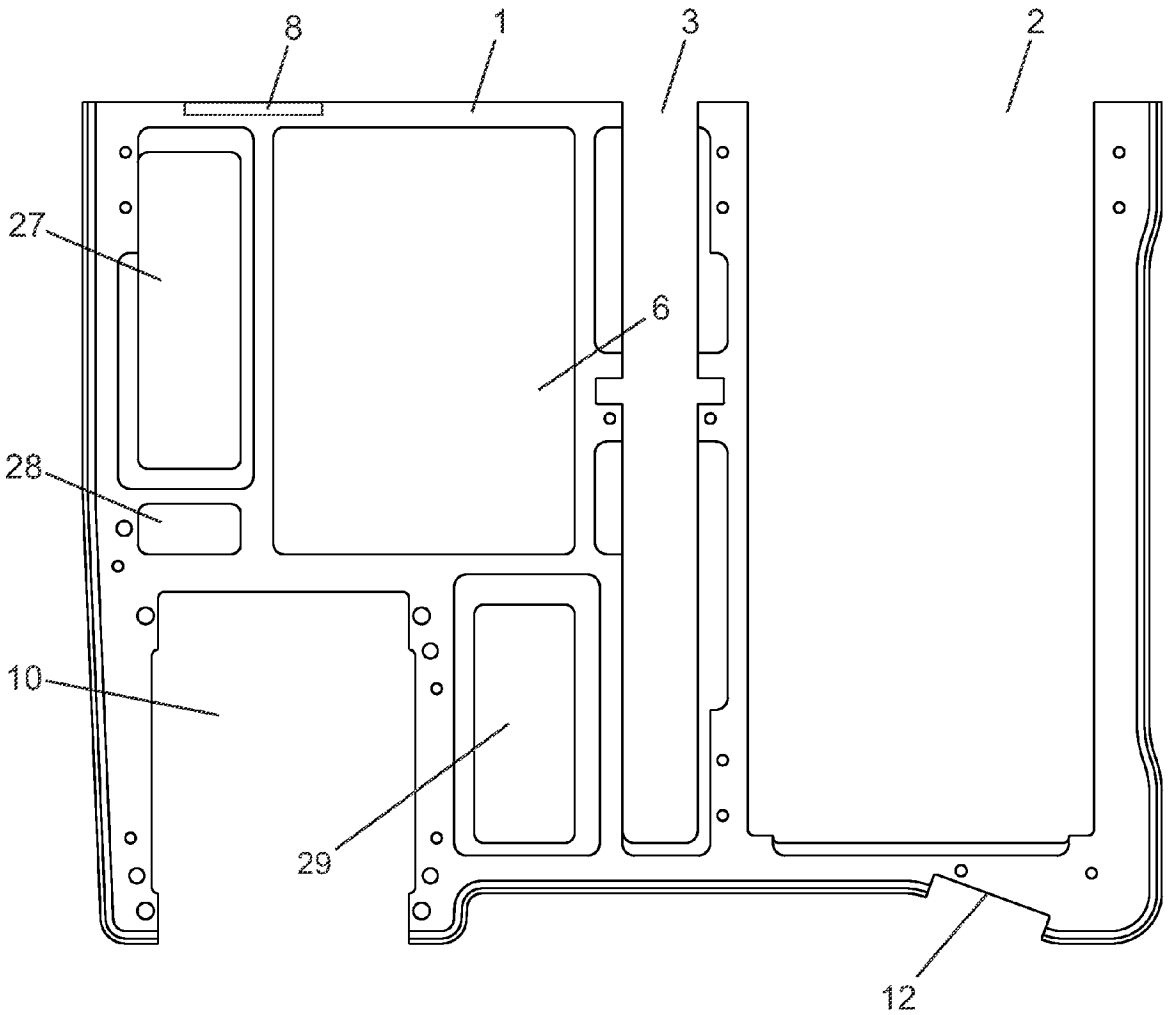
FIG. 1 shows the central rib in cross section
Figure 2:
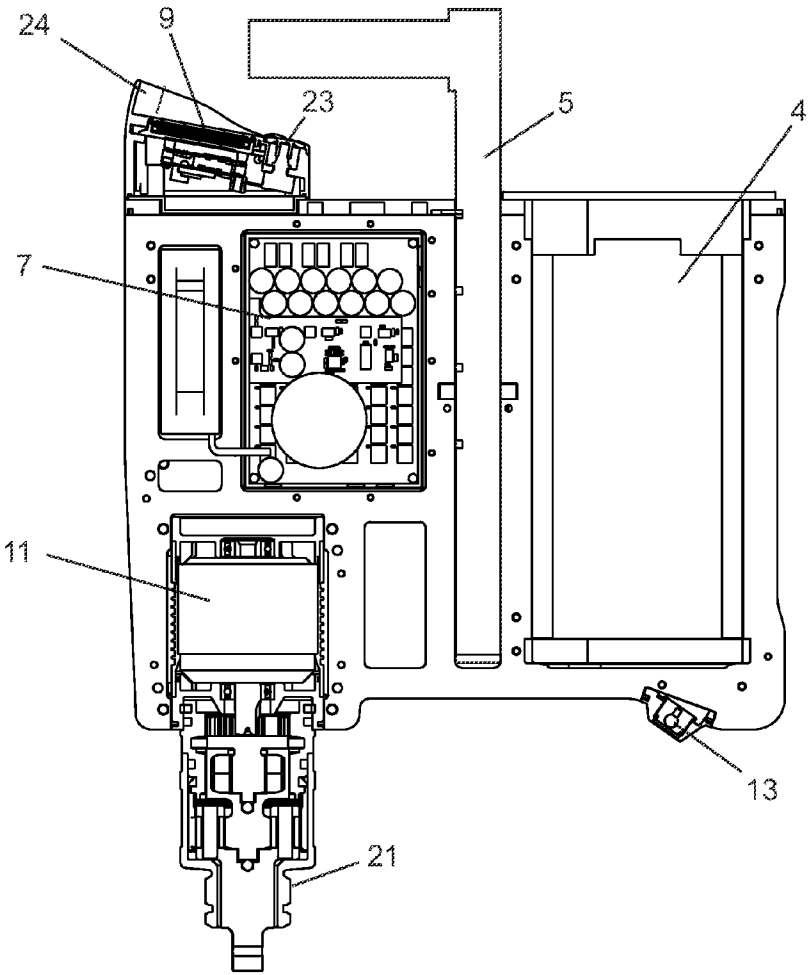
FIG. 2 shows the central rib with installation parts in cross section
Figure 5:
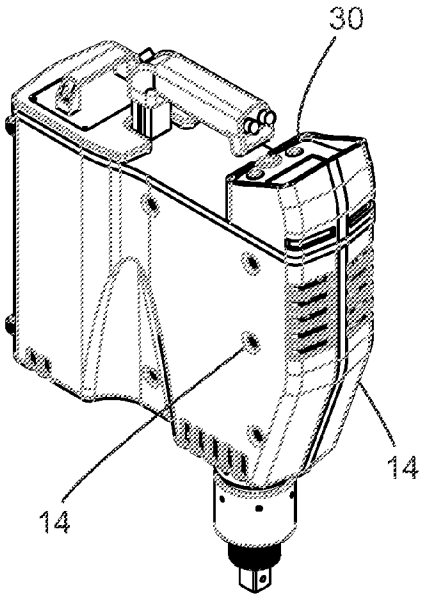
FIG. 5 shows the device without counter torque wrench in 3D view
Figure 3:
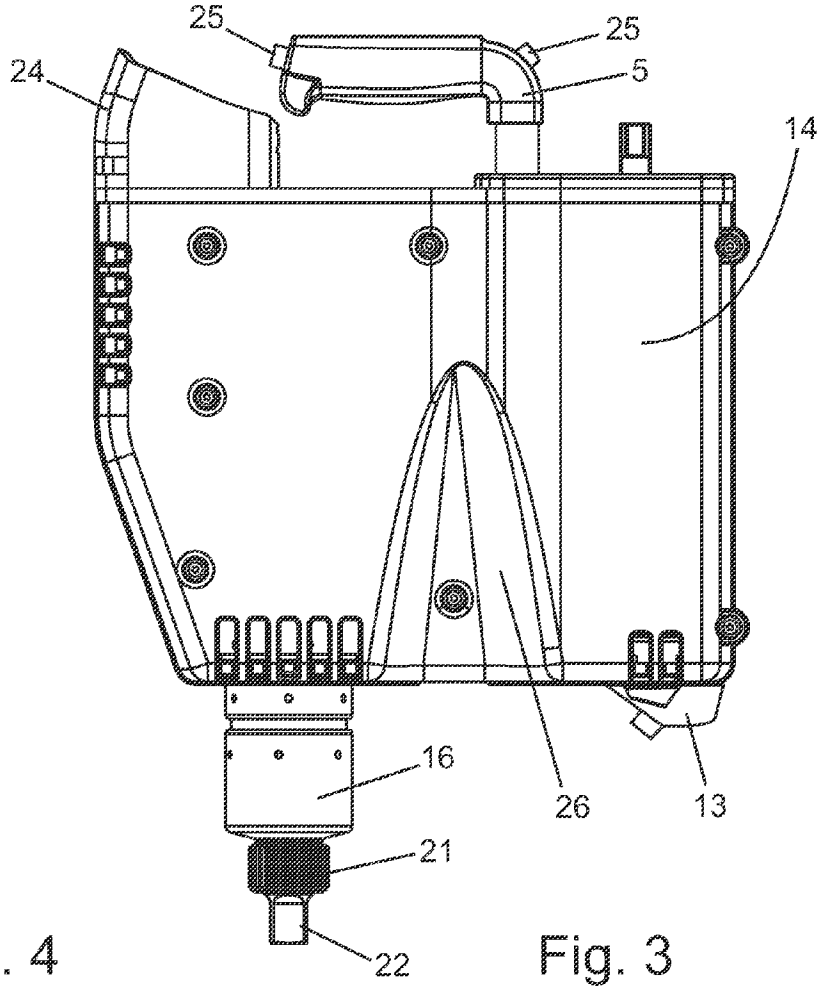
FIG. 3 shows the device without counter torque wrench in the lateral view
Figure 4:
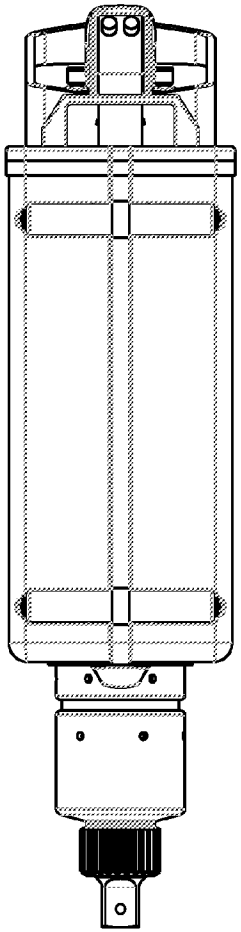
FIG. 4 shows the device without counter torque wrench in the frontal view
Figure 6:
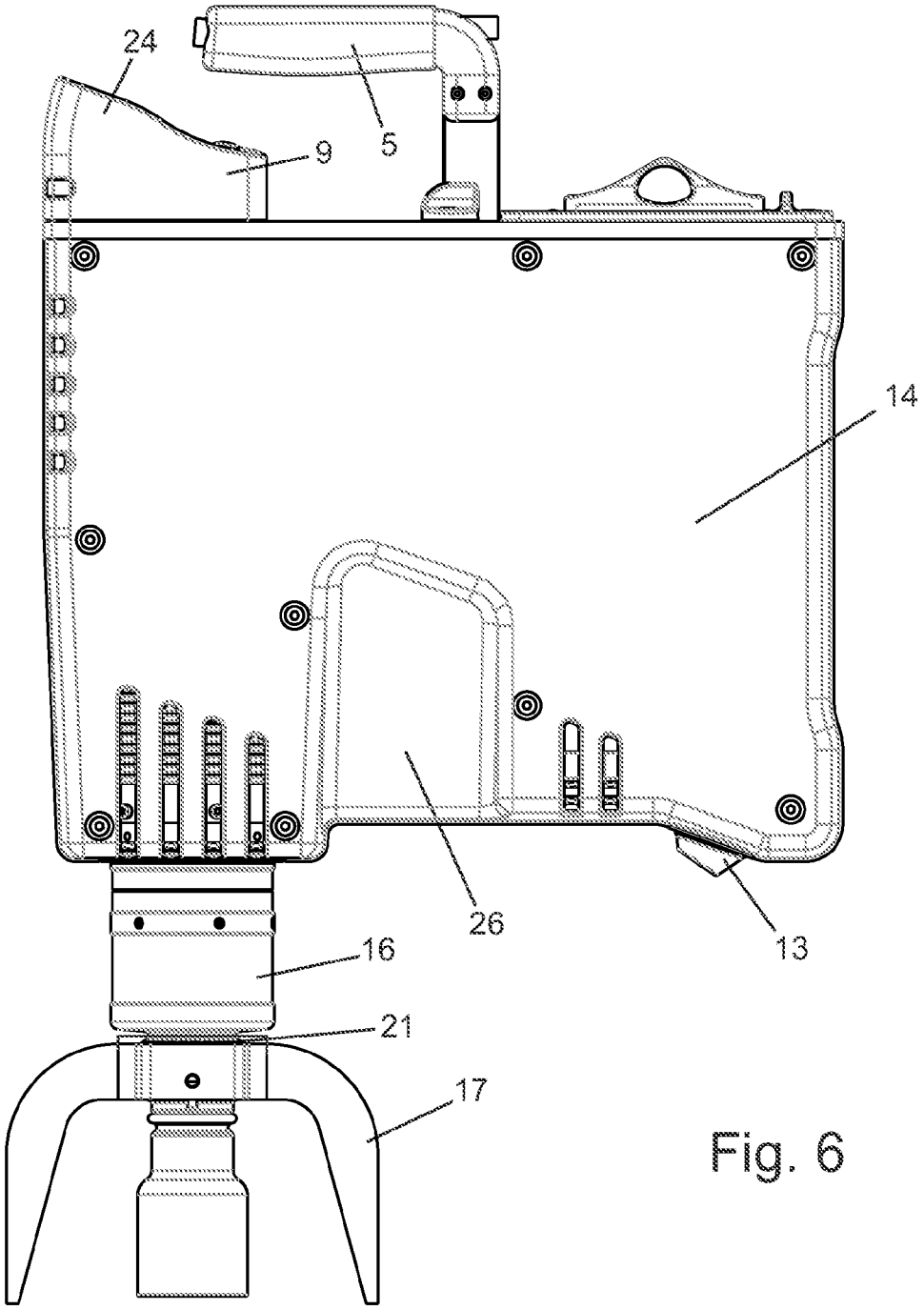
FIG. 6 shows the device with counter torque wrench in the cross section
Figure 7:
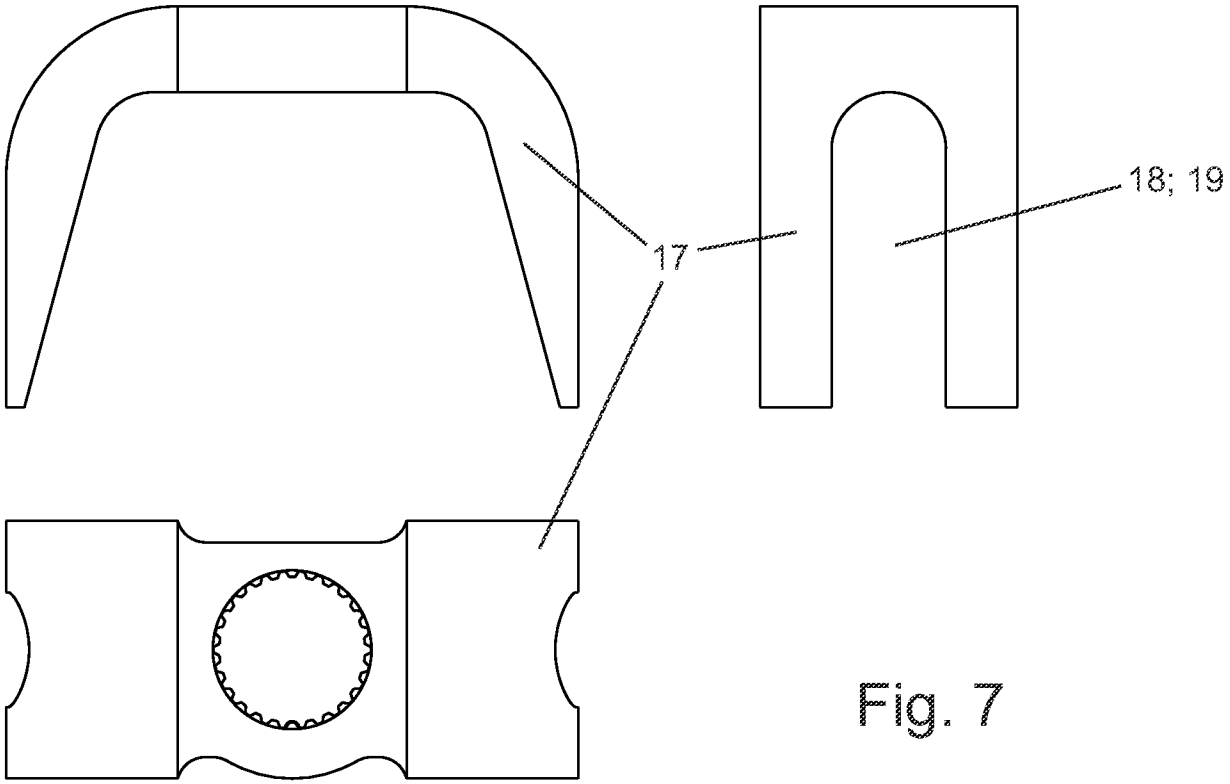

FIG. 7 shows the counter torque wrench in the cross section and longitudinal section as well as in top view The central rib 1 comprises U-shaped slots 2 and 3 for the battery 4 and the grab handle 5 as well as compartment 6 opened to the side for the control device 7, a horizontally upwards oriented seating 8 for the display 9 and a U-shaped insert 10 opened to the bottom for the machine-drive 11 as well as an insert 12, also oriented downwards, for the illumination device 13 and two slots 28; 29 for cables.

Around the central rib 1 and the mentioned add-on or installed modules, the two-shell housing 14 is formed, below which the U-shaped counter torque wrench 17 with its two fork-shaped recesses 18;19 is arranged, which is attached at the sheath 16. Inside the sheath 16, the rotating parts 15 are arranged, which are guided in a rotatable manner via a special bearing 20. At the lower end of the rotatable parts 15, a gearing 21 and a socket seating 22 are arranged.

At the grab handle 5, at least one changeover switch 25 is arranged in both working directions.

The display 9 is designed so as to be angled and has a rotatable knob 23 as well as a sun shield 24.

In the lower area of the two-shell housing 14, between the rotatable parts 15 and the illumination device 13, the recess area 26 is arranged as a mesh area for fixing and holding the screwing device.

Optionally, the central rib 1 has a seating 27 for a fan.

PARTS LIST

1—central rib
2—insert
3—insert
4—battery
5—grab handle
6—side compartment
7—control device
8—seating
9—display

10—insert
11—machine-drive
12—insert
13—illumination device
14—two-shell housing
15—rotatable parts
16—sheath
17—counter torque wrench
18—fork-shaped recess
19—fork-shaped recess
20—ball bearing
21—gear wheel
22—socket seating
23—rotatable knob
24—sun shield
25—changeover switch
26—recess
27—seating
28—insert
29—insert
30—set button

The invention claimed is:

1. Device for screwing and unscrewing bolts and screws by a motor-driven screwing tool, which is preferably used in a track region of railroad facilities and comprises a two-shell housing, wherein the device has a central rib (1) which serves as a reception area for all add-on or installed modular components, and wherein the central rib (1) has a first and a second U-shaped inserts which are open to the top and wherein the first U-shaped insert is meant for a battery (4) and the second U-shaped insert is meant for a grab handle (5), a compartment (6) that is open to the side and is meant for a control device (7), a reception area (8) that is aligned horizontally upward and is meant for a display (9), a U-shaped insert (10) that is open to the bottom and is meant for the machine-drive (11), and a downward-facing insert (12) for an illumination device (13), which are arranged preferably inside a two-shell housing.

2. Device according to claim 1, wherein a sheath (16) that is guided around the rotating parts (15) is attached at the machine-drive (11) or at the two-shell housing (14) or at the central rib (1), with a preferably U-shaped counter torque wrench (17) being formed at the sheath (16).

3. Device according to claim 2, wherein the counter torque wrench (17) has a fork-shaped recess (18; 19) at both of its ends.

4. Device according to claim 2, wherein a special slewing ring (21) is arranged between the sheath (16) and the rotating parts (15).

5. Device according to claim 2, wherein the counter torque wrench (17) is designed so as to be rotatable.

6. Device according to claim 2, wherein the rotating parts (15) are formed as drill chuck, wherein a gearing (21) and then a socket seating (22) are arranged at the lower end of the gear box.

7. Device according to claim 1, wherein the display (9) is arranged in a rotatable manner, so that the device can be used in two directions in the same orientation.

8. Device according to claim 1, wherein the display (9) has a rotatable knob (23) for selecting different menu items, wherein each menu item can be adjusted and calibrated according to a special kind of screw, a special fastening variant of the tracks or a special torque, among other things.

9. Device according to claim 1, wherein the display (9) has one or a plurality of set buttons (30) for menu control and/or for activating the selected menu items.

10. Device according to claim 1, wherein the display (9) is designed so as to have an angled position and comprises a sun shield (24).

11. Device according to claim 1, wherein a GPS receiver which is connected to a data processing unit is arranged inside the housing (14).

12. Device according to claim 1, wherein the grab handle (5) has respectively one changeover switch (25) for the rotational direction of the tool that is located in forward direction and/or backward direction with regard to the working direction.

13. Device according to claim 1, wherein the grab handle (5) is formed so as to be height-adjustable and open to one side as well as removable and/or rotatable.

14. Device according to claim 1, wherein it is connected to a rail car via a height-adjustable side arm and is attached at the rail car.

15. Device according to claim 14, wherein the rail car has a container for receiving an (additional) battery or an aggregate.

16. Device according to claim 15, wherein the aggregate is a power generating set equipped with a combustion engine, with the power generating set being connected to the screwing device.

17. Device according to claim 1, wherein it has an illumination (13) that is preferably arranged in the lower area of the housing (14) and positioned at an angle towards a working tool.

18. Device according to claim 1, wherein a double-sided recovery (26) is arranged in the lower area of the two-shell housing (14) as a meshing area for fixating and holding the device.

19. Device according to claim 18, wherein a grab handle is integrated inside the recovery area (26).

20. Device according to claim 1, wherein a fan is arranged inside the two-shell housing (14).

21. Device according to claim 1, wherein the entire screwing device is formed in such a manner that a complete counterbalance adjustment occurs for a one-hand operation at vertical screw connections.

22. Device according to claim 1, wherein equipment by which a contactless read-out of stored data is facilitated is located inside the housing (14).

* * * * *